US009400114B2

(12) United States Patent
Melton et al.

(10) Patent No.: US 9,400,114 B2
(45) Date of Patent: Jul. 26, 2016

(54) COMBUSTOR SUPPORT ASSEMBLY FOR MOUNTING A COMBUSTION MODULE OF A GAS TURBINE

(71) Applicant: General Electric Company, Schenectady, NY (US)

(72) Inventors: Patrick Benedict Melton, Horse Shoe, NC (US); Lucas John Stoia, Taylors, SC (US); Richard Martin DiCintio, Simpsonville, SC (US); Christopher Paul Willis, Liberty, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 630 days.

(21) Appl. No.: 13/845,699

(22) Filed: Mar. 18, 2013

(65) Prior Publication Data

US 2014/0260319 A1 Sep. 18, 2014

(51) Int. Cl.

| | |
|---|---|
| ***F23R 3/60*** | (2006.01) |
| ***F23R 3/34*** | (2006.01) |
| ***F23R 3/00*** | (2006.01) |

(52) U.S. Cl.

CPC . *F23R 3/60* (2013.01); *F23R 3/005* (2013.01); *F23R 3/34* (2013.01); *F23R 2900/00017* (2013.01); *F23R 2900/00019* (2013.01)

(58) Field of Classification Search

CPC ..... F23R 3/60; F23R 2900/00017; F23R 2900/00019; F23R 3/34; F23R 3/286

See application file for complete search history.

(56) References Cited

U.S. PATENT DOCUMENTS

| | | | |
|---|---|---|---|
| 3,872,664 | A | 3/1975 | Lohmann |
| 4,265,615 | A | 5/1981 | Lohmann |
| 4,420,929 | A | 12/1983 | Jorgensen |
| 5,069,029 | A | 12/1991 | Kuroda |
| 5,380,154 | A | 1/1995 | Norton |
| 5,450,725 | A | 9/1995 | Takahara |
| 5,475,979 | A | 12/1995 | Oag |
| 5,802,854 | A | 9/1998 | Maeda |

(Continued)

FOREIGN PATENT DOCUMENTS

| | | | |
|---|---|---|---|
| EP | 0526058 | A1 | 3/1993 |
| EP | 0578461 | A1 | 12/1994 |
| EP | 1884297 | A1 | 2/2008 |

OTHER PUBLICATIONS

Co-Pending U.S. Appl. No. 13/845,439, dated Mar. 18, 2013.

(Continued)

*Primary Examiner* — Gerald L Sung
*Assistant Examiner* — Thomas Burke
(74) *Attorney, Agent, or Firm* — Dority & Manning, PA

(57) ABSTRACT

A gas turbine comprises a compressor discharge casing that is coupled to an outer turbine shell. The compressor discharge casing includes a combustor opening that extends through the compressor discharge casing and an outer mating surface that circumferentially surrounds the combustor opening. The outer turbine shell defines an inner mating surface. A combustion module extends through the combustor opening. The combustion module includes a forward end that is circumferentially surrounded by a mounting flange and an aft end that is circumferentially surrounded by an aft frame. The mounting flange extends circumferentially around the combustor opening. The mounting flange is coupled to the outer mating surface of the compressor discharge casing and the aft frame is coupled to the inner mating surface of the outer turbine shell.

9 Claims, 6 Drawing Sheets

(56) References Cited

U.S. PATENT DOCUMENTS

| | | | | |
|---|---|---|---|---|
| 6,047,550 | A | 4/2000 | Beebe | |
| 6,148,604 | A | 11/2000 | Salt | |
| 6,212,870 | B1 | 4/2001 | Thompson et al. | |
| 6,374,594 | B1 | 4/2002 | Kraft et al. | |
| 6,442,946 | B1 | 9/2002 | Kraft | |
| 6,450,762 | B1 | 9/2002 | Munshi | |
| 6,543,993 | B2 | 4/2003 | Burdgick et al. | |
| 6,654,710 | B1 | 11/2003 | Keller | |
| 6,875,009 | B2 | 4/2005 | Kayahara et al. | |
| 6,896,509 | B2 | 5/2005 | Carroni et al. | |
| 6,957,949 | B2 | 10/2005 | Hyde et al. | |
| 7,082,766 | B1 | 8/2006 | Widener et al. | |
| 7,743,612 | B2 | 6/2010 | Morenko | |
| 8,096,131 | B2 | 1/2012 | Ziaei et al. | |
| 8,158,428 | B1 | 4/2012 | Krishna | |
| 8,171,738 | B2 | 5/2012 | Fish et al. | |
| 2002/0184893 | A1 | 12/2002 | Farmer | |
| 2003/0039542 | A1 | 2/2003 | Cromer | |
| 2005/0044855 | A1 | 3/2005 | Crawley | |
| 2005/0241317 | A1 | 11/2005 | Martling | |
| 2005/0268617 | A1* | 12/2005 | Amond, III | F02C 9/34 60/776 |
| 2006/0230763 | A1* | 10/2006 | Johnson | F23R 3/10 60/740 |
| 2007/0089425 | A1* | 4/2007 | Motter | F02C 3/30 60/775 |
| 2008/0282667 | A1 | 11/2008 | Intile | |
| 2009/0071157 | A1 | 3/2009 | Cai | |
| 2009/0199561 | A1 | 8/2009 | Hessler | |
| 2010/0005803 | A1* | 1/2010 | Tu | F01D 9/023 60/752 |
| 2010/0054928 | A1 | 3/2010 | Schiavo | |
| 2010/0071377 | A1 | 3/2010 | Fox | |
| 2010/0139283 | A1 | 6/2010 | Phillips et al. | |
| 2010/0170216 | A1 | 7/2010 | Venkataraman | |
| 2010/0170251 | A1* | 7/2010 | Davis, Jr. | F02C 7/228 60/740 |
| 2010/0174466 | A1 | 7/2010 | Davis, Jr. et al. | |
| 2010/0263386 | A1* | 10/2010 | Edwards | F23R 3/60 60/796 |
| 2011/0067402 | A1* | 3/2011 | Wiebe | F23R 3/08 60/740 |
| 2011/0146284 | A1 | 6/2011 | Morimoto | |
| 2011/0247314 | A1 | 10/2011 | Chila | |
| 2011/0304104 | A1 | 12/2011 | McMahan | |
| 2011/0314823 | A1* | 12/2011 | Smith | F23R 3/002 60/737 |
| 2012/0169326 | A1* | 7/2012 | Krishna | F23M 5/02 324/240 |
| 2012/0186260 | A1 | 7/2012 | DiCintio et al. | |
| 2012/0210729 | A1 | 8/2012 | Cihlar et al. | |
| 2012/0304648 | A1* | 12/2012 | Byrne | F23R 3/06 60/737 |
| 2014/0033728 | A1 | 2/2014 | Marmilic | |
| 2014/0116066 | A1* | 5/2014 | Melton | F23R 3/28 60/806 |
| 2014/0260272 | A1 | 9/2014 | DiCintio | |

OTHER PUBLICATIONS

Co-Pending U.S. Appl. No. 13/845,365, dated Mar. 18, 2013.
Co-Pending U.S. Appl. No. 13/845,485, dated Mar. 18, 2013.
Co-Pending U.S. Appl. No. 13/845,565, dated Mar. 18, 2013.
Co-Pending U.S. Appl. No. 13/845,617, dated Mar. 18, 2013.
Co-Pending U.S. Appl. No. 13/845,661, dated Mar. 18, 2013.
Co-Pending U.S. Appl. No. 13/845,384, dated Mar. 18, 2013.
Co-Pending U.S. Appl. No. 13/845,378, dated Mar. 18, 2013.

* cited by examiner

COMBUSTOR SUPPORT ASSEMBLY FOR MOUNTING A COMBUSTION MODULE OF A GAS TURBINE

FIELD OF THE INVENTION

The present invention generally involves a gas turbine. More specifically, the invention relates to a combustor support assembly for mounting a combustion module to a gas turbine.

BACKGROUND OF THE INVENTION

Combustors are commonly used in industrial and power generation operations to ignite fuel to produce combustion gases having a high temperature and pressure. For example, turbo-machines such as gas turbines typically include one or more combustors to generate power or thrust. A typical gas turbine includes an inlet section, a compressor section, a combustion section, a turbine section, and an exhaust section. The inlet section cleans and conditions a working fluid (e.g., air) and supplies the working fluid to the compressor section. The compressor section increases the pressure of the working fluid and supplies a compressed working fluid to the combustion section. The compressed working fluid and a fuel are mixed within the combustion section and burned to generate combustion gases having a high temperature and pressure. The combustion gases flow to the turbine section where they expand to produce work. For example, expansion of the combustion gases in the turbine section may rotate a shaft connected to a generator to produce electricity.

The combustion section generally includes at least one combustor. A typical combustor includes an end cover coupled to a compressor discharge casing, an annular cap assembly that extends radially and axially within the compressor discharge casing, an annular liner that extends downstream from the cap assembly, and a transition piece that extends between the liner and a first stage of stationary nozzles that are positioned generally adjacent to an inlet to the turbine section.

In a common mounting scheme, a forward end of the liner circumferentially surrounds an aft end portion of the cap assembly. A spring seal or hula seal extends circumferentially around the aft end portion of the cap assembly and radially between the cap assembly and the forward end of the liner to provide a seal therebetween and/or to provide mounting support to the forward end of the liner. A forward end of the transition piece circumferentially surrounds an aft end of the liner. A spring seal or hula seal extends circumferentially around the aft end of the liner and radially between the liner and the forward end of the transition piece to provide a seal therebetween and/or to provide mounting support to the aft end of the liner. An aft frame portion of the transition piece is coupled to a turbine casing. In addition or in the alternative, a mounting bracket is or may be used to couple a bottom portion of the transition piece to the compressor discharge casing. In this mounting scheme, the transition piece is utilized to constrain the liner within the combustor. Although this mounting scheme is generally effective, it is not practical for newer and more compact gas turbine designs.

In continued efforts to decrease the overall size or footprint of gas turbines, the outer circumference of the compressor discharge casing for certain gas turbines has been decreased. As a result, access to the combustor, particularly the bottom portion of the transition piece and or the liner during installation and removal of the combustor has been restricted. In addition, in an effort to decrease the number of individual components within the combustor of the gas turbine, the transition piece and the combustion liner of certain gas turbine combustors have been combined into a single liner component that is at least partially surrounded by one or more flow sleeves and/or impingement sleeves. As a result, the existing mounting schemes are generally ineffective and/or impractical for mounting the newer combustor types within the smaller compressor discharge casing. Therefore, an improved combustor support assembly for mounting a combustion module of a gas turbine would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor support assembly for a gas turbine. The combustion module generally includes a compressor discharge casing that is coupled to an outer turbine shell. The compressor discharge casing includes a combustor opening that extends through the compressor discharge casing and an outer mating surface that circumferentially surrounds the combustor opening. The outer turbine shell defines an inner mating surface. A combustion module extends through the combustor opening. The combustion module includes a forward end that is circumferentially surrounded by a mounting flange and an aft end that is circumferentially surrounded by an aft frame. The mounting flange extends circumferentially around the combustor opening. The mounting flange is coupled to the outer mating surface of the compressor discharge casing and the aft frame is coupled to the inner mating surface of the outer turbine shell.

Another embodiment of the present invention is a combustor support assembly for a gas turbine. The combustor support assembly includes a compressor discharge casing that is coupled to an outer turbine shell. The compressor discharge casing has a combustor opening that extends through the compressor discharge casing and an outer mating surface that circumferentially surrounds the combustor opening. The outer turbine shell defines an inner mating surface. An annular fuel distribution manifold extends through the combustor opening. The fuel distribution manifold includes a forward end and an aft end. The fuel distribution manifold has a mounting flange at the forward end and an annular support ring at the aft end. The support ring has an inner support portion. A fuel injection assembly extends downstream from the fuel distribution manifold. The fuel injection assembly includes a forward end and an aft end. The fuel injection assembly comprises an annular support sleeve that is disposed at the forward end and an aft frame that is disposed at the aft end. The support sleeve includes a forward end that is at least partially surrounded by the inner support portion of the support ring. The mounting flange of the fuel distribution manifold is coupled to the outer mating surface of the compressor discharge casing. The aft frame of the fuel injection assembly is coupled to the inner mating surface of the outer turbine shell.

The present invention may also include a combustor support assembly for a gas turbine having a compressor discharge casing coupled to an outer turbine shell. The compressor discharge casing includes a combustor opening that extends through the compressor discharge casing and an outer mating surface that circumferentially surrounds the combustor opening. The outer turbine shell defines an inner mating surface. An annular fuel distribution manifold extends through the combustor opening. The fuel distribution manifold has a mounting flange at a forward end and an annular support ring disposed at an aft end. The mounting flange defines a first mating surface that is axially separated from a second mating surface. The support ring includes an inner support portion. A fuel injection assembly extends downstream from the fuel distribution manifold. The fuel injection assembly has a forward end and an aft end. The fuel injection assembly includes an annular support sleeve that is disposed at the forward end and an aft frame that is disposed at the aft end. The support sleeve is coupled to the aft frame by at least one of an annular flow sleeve or an annular impingement sleeve. The support sleeve includes a forward end that is at least partially surrounded by the inner support portion of the support ring. An annular spacer casing has a radially extending end cover disposed at a first end and a flange at a second end. The flange is coupled to the second mating surface of the mounting flange. The annular spacer casing and the mounting flange are coupled to the outer mating surface of the compressor discharge casing. The aft frame of the fuel injection assembly is coupled to the inner mating surface of the outer turbine shell.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
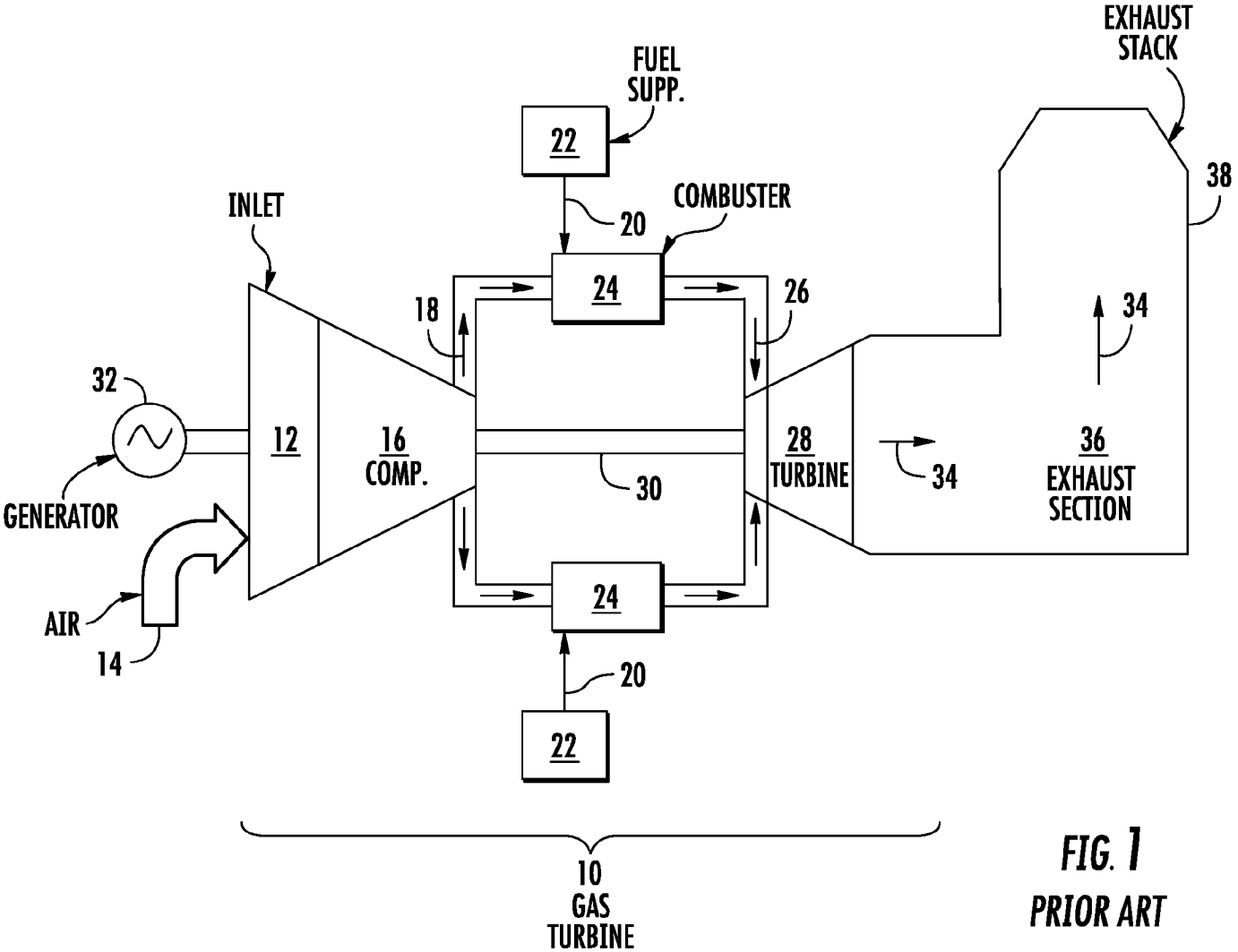
FIG. 1 PRIOR ART
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a combustor incorporated into a gas turbine for purposes of illustration, one of ordinary skill in the art will readily appreciate that embodiments of the present invention may be applied to any combustor incorporated into any turbomachine and is not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state.

The compressed working fluid 18 is mixed with a fuel 20 from a fuel supply 22 to form a combustible mixture within one or more combustors 24. The combustible mixture is burned to produce combustion gases 26 having a high temperature and pressure. The combustion gases 26 flow through a turbine 28 of a turbine section to produce work. For example, the turbine 28 may be connected to a shaft 30 so that rotation of the turbine 28 drives the compressor 16 to produce the compressed working fluid 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
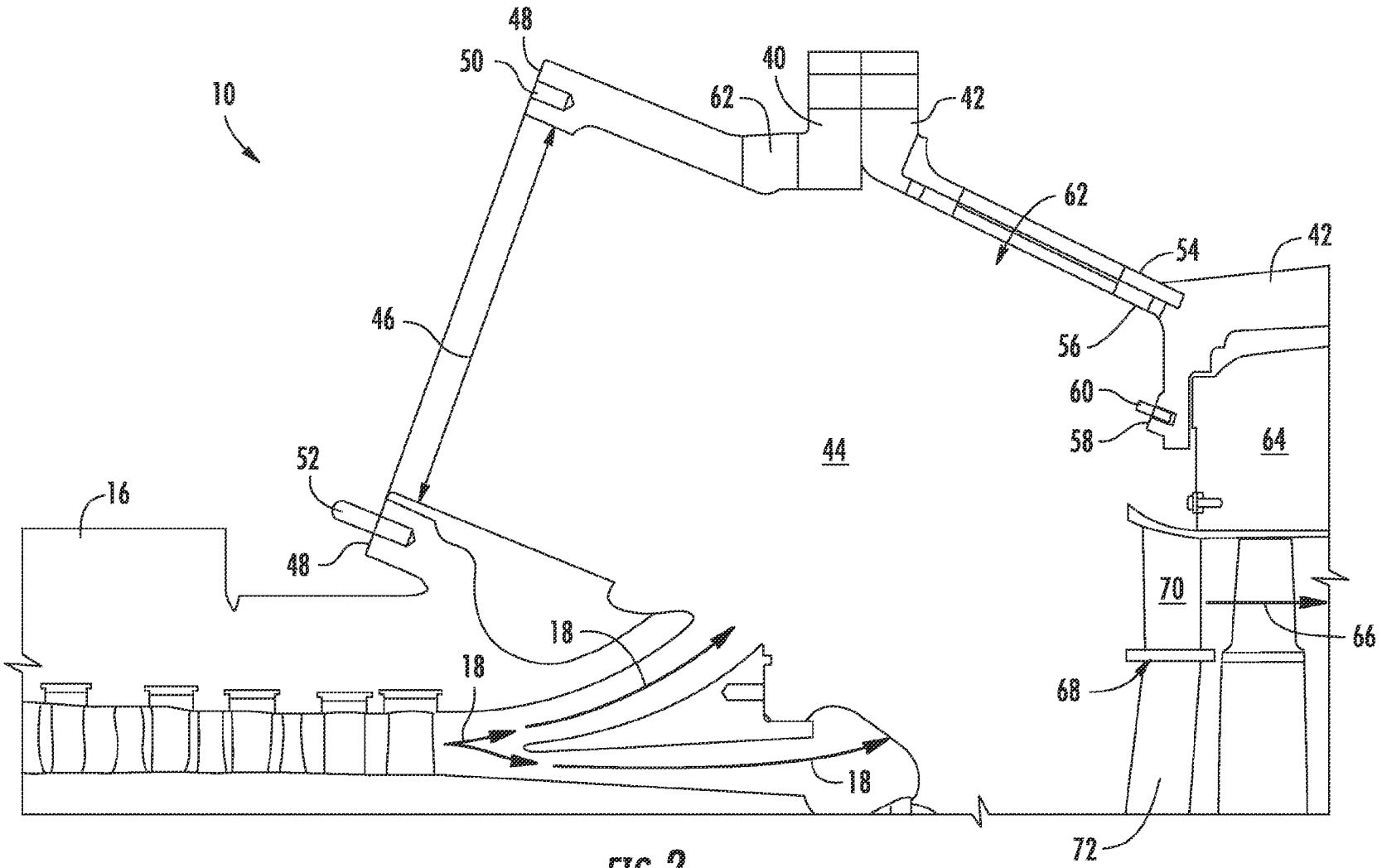
FIG. 2 is a cross-section side view of a portion of an exemplary gas turbine according to various embodiments of the present invention.

FIG. 2 provides a cross-section side view of a portion of the gas turbine 10 according to various embodiments of the present disclosure. As shown, the gas turbine generally includes a compressor discharge casing 40 that is in fluid communication with the compressor 16. An outer turbine casing or shell 42 is coupled to the compressor discharge casing 40. The outer turbine shell 42 and the compressor discharge casing 40 at least partially define a high pressure plenum 44 that is in fluid communication with the compressor 16.

The compressor discharge casing 40 at least partially defines a combustor opening 46 for installing a combustor (not shown) into the gas turbine 10. The compressor discharge casing 40 at least partially defines an outer mating surface 48 that extends circumferentially around the combustor opening 46. A plurality of fastener holes 50 extends through the outer mating surface 48 and into the compressor discharge casing 40. The fastener holes 50 may be tapped and/or threaded to receive a fastener such as a bolt or a threaded insert. In particular embodiments, a guide pin 52 extends outward from the outer mating surface 48 of the compressor discharge casing 40.

The outer turbine shell 42 includes an outer surface 54 and an inner surface 56. In one embodiment, an inner mating surface 58 is at least partially defined by the inner surface 56. In particular embodiments, a guide pin 60 extends from the inner mating surface 58. In particular embodiments, a service access opening 62 such as an arm-way or a man-way extends through the outer turbine shell 42. The service access opening 62 is positioned generally proximate to the inner mating surface 58 to allow for access to the inner mating surface 58 during installation and removal of the combustor 24 (not shown). In alternate embodiments, the service access opening 62 extends through the compressor discharge casing 40 in a manner that allows for access to the inner mating surface 58 during installation and removal of the combustor 24 (not shown).

In particular embodiments, an inner turbine shell 64 is at least partially surrounded by the outer turbine shell 42. The inner turbine shell 64 at least partially defines a hot gas path 66 that extends through the turbine 28. The inner turbine shell 64 may at least partially support a first stage 68 of a plurality of stationary nozzles 70. For example, the plurality of stationary nozzles 70 may be coupled to the inner turbine shell 64. In addition or in the alternative, the plurality of stationary nozzles 70 may be coupled to at least one nozzle support ring 72 that extends circumferentially within the high pressure plenum 44.

Figure 3:
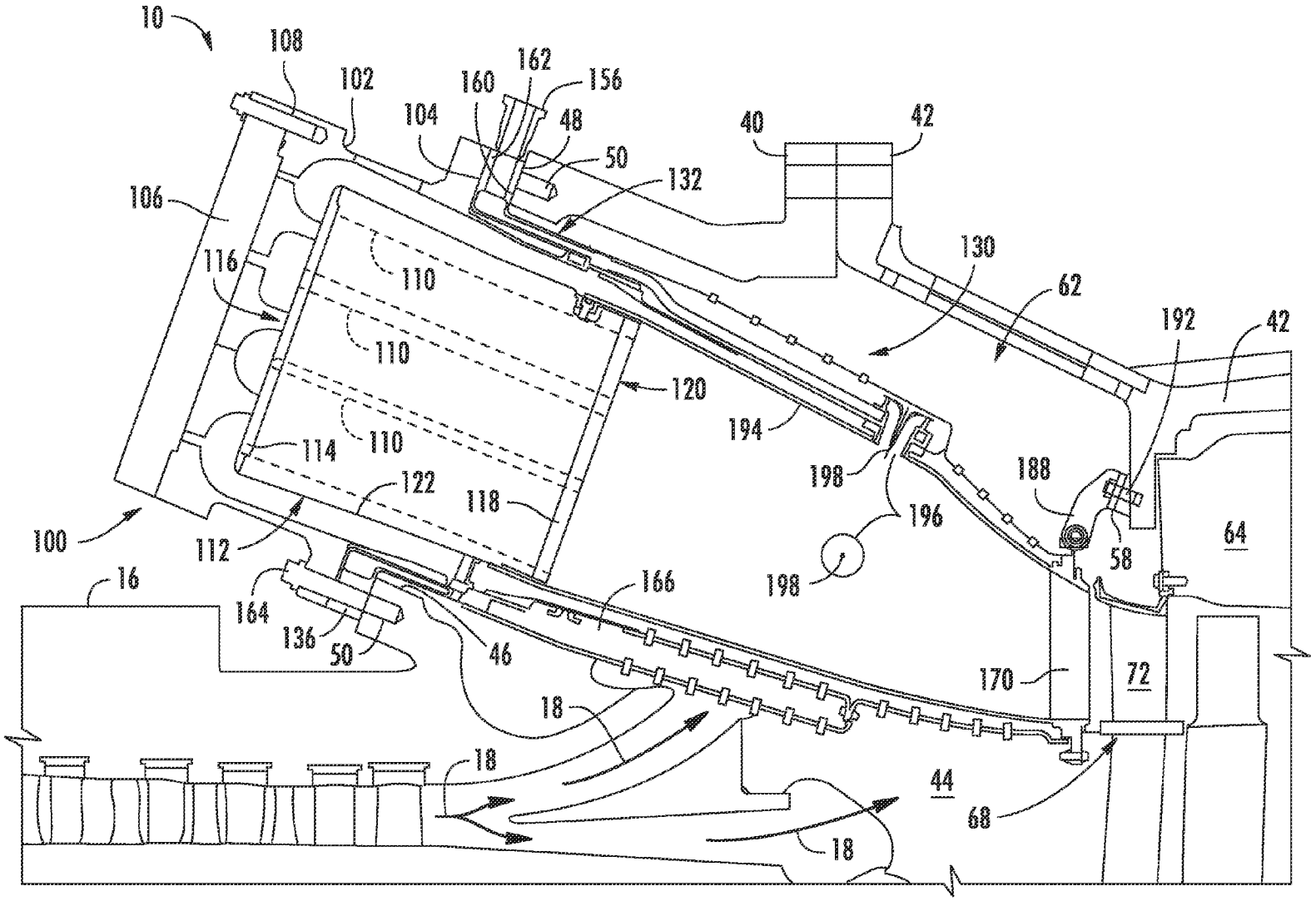
FIG. 3 is a cross-section side view of a portion of the gas turbine as shown in FIG. 2 including a combustor, according to various embodiments of the present invention.

FIG. 3 provides a cross-section side view of the portion of the gas turbine as shown in FIG. 2, according to various embodiments of the present disclosure. As shown in FIG. 3, a combustor 100 extends through the combustor opening 46 of the compressor discharge casing 40. In particular embodiments, the combustor 100 includes an annular spacer casing 102. An aft end 104 of the spacer casing 102 is coupled to the outer mating surface 48 of the compressor discharge casing 40. A radially extending end cover 106 is disposed at a forward end 108 of the spacer casing 102. One or more axially extending fuel nozzles 110 extend downstream from the end cover 106 within the spacer casing 102.

In particular embodiments, the combustor 100 further includes a radially extending annular cap assembly 112. The cap assembly 112 is disposed downstream from the end cover 106 and at least partially surrounds each and/or some of the one or more axially extending fuel nozzles 110. The cap assembly 112 generally includes a radially extending base plate 114 that is disposed at an upstream end 116 of the cap assembly 112 that is generally adjacent to the end cover 106, a radially extending cap plate 118 that is disposed at a downstream end 120 of the cap assembly 112, and one or more annular shroud(s) 122 that extend at least partially between the base plate 114 and the cap plate 118. The cap assembly 112 generally extends at least partially through the combustor opening 46 of the compressor discharge casing. A radially extending spring seal or hula seal (not shown) may at least partially circumferentially surround the downstream end 120 of the cap assembly 112.

Figure 4:
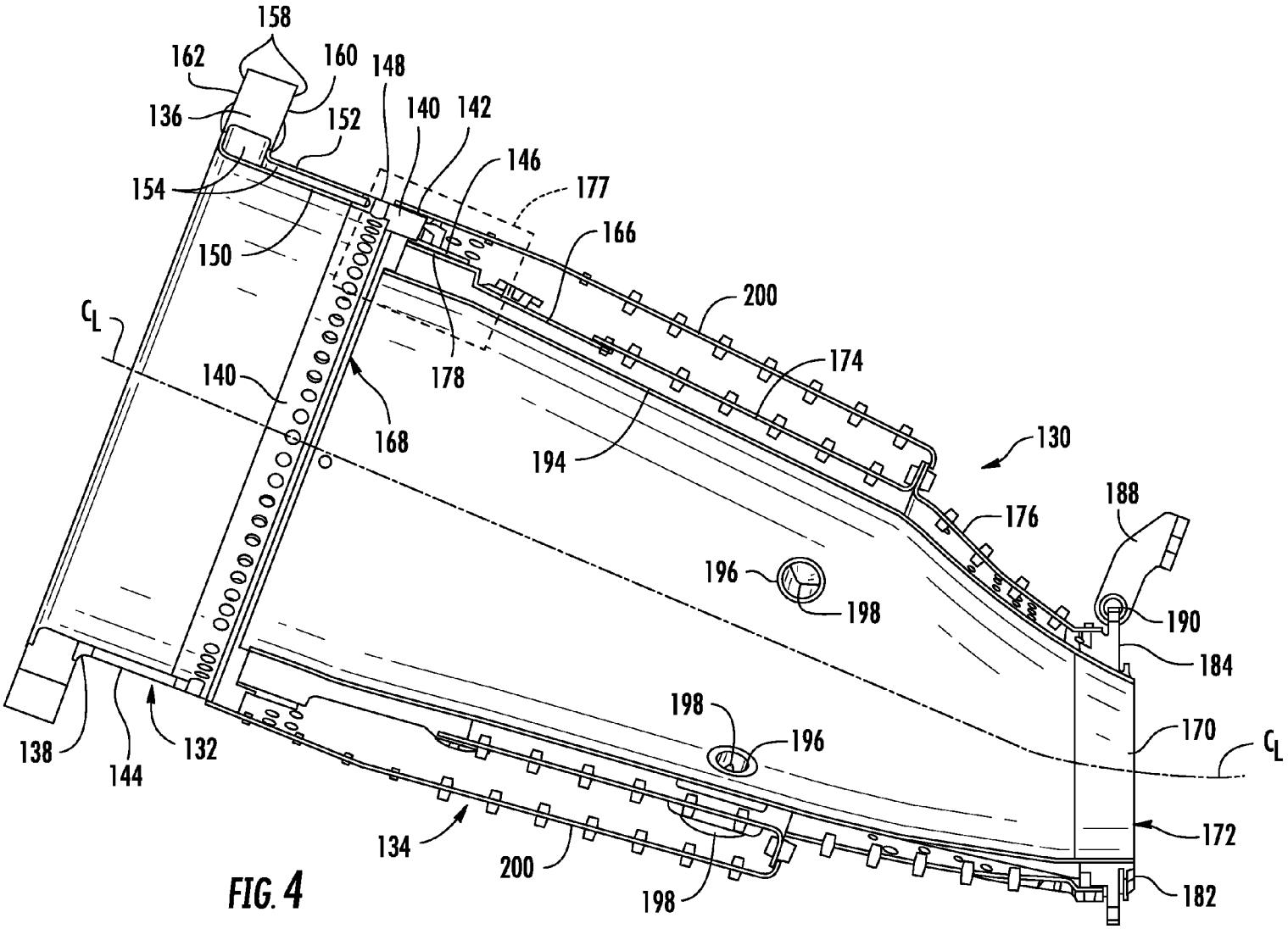
FIG. 4 is an enlarged cross-section side view of a combustion module of the combustor as shown in FIG. 3, according to at least one embodiment of the present disclosure.

As shown in FIG. 3, the combustor 100 includes a combustion module 130 that extends through the combustor opening 46 of the compressor discharge casing 40 and that terminates at a point that is generally adjacent to the first stage 68 of the plurality of stationary nozzles 72. FIG. 4 provides a cross-section side view of the combustion module 130 as shown in FIG. 3. In particular embodiments, as shown in FIG. 4 the combustion module 130 generally comprises an annular fuel distribution manifold 132 and a fuel injection assembly 134. As shown in FIG. 3, the cap assembly 122 extends at least partially through the fuel distribution manifold 132 towards the fuel injection assembly 134. The fuel injection assembly 134 extends downstream from the fuel distribution manifold 132.

In particular embodiments, the fuel distribution manifold 132 includes a mounting flange 136 that circumferentially surrounds an upstream or forward end 138 of the fuel distribution manifold 132, an annular support ring 140 that circumferentially surrounds an aft or downstream end 142 of the fuel distribution manifold 132, and an annular sleeve 144 that extends b54etween the mounting flange 136 and the support ring 140. As shown in FIG. 4, the support ring 140 generally includes an inner portion 146 radially separated from an outer portion 148.

Figure 5:
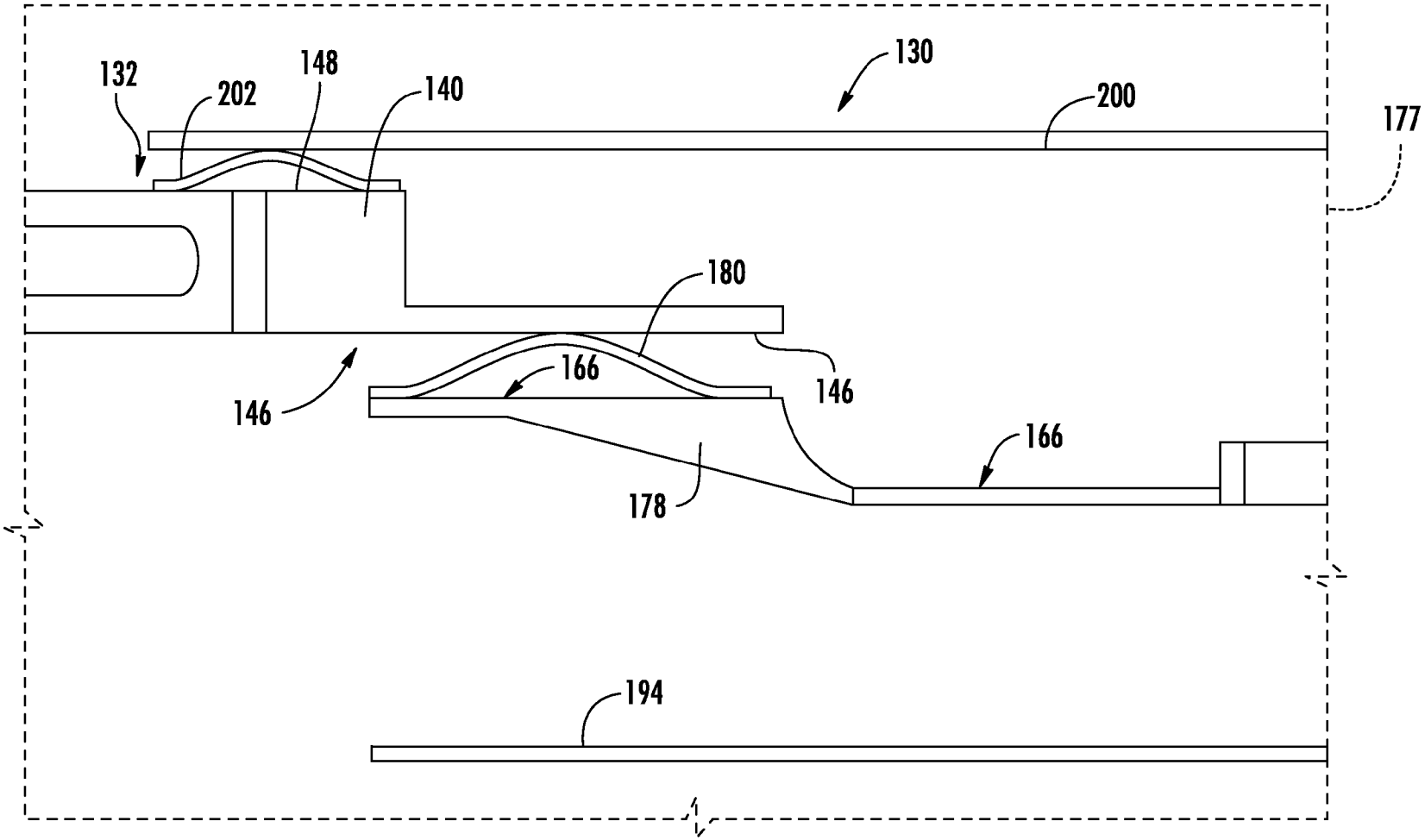
FIG. 5 is an enlarged view of a portion of the combustion module a shown in FIG. 4, according to at least one embodiment of the present disclosure.
Figure 6:
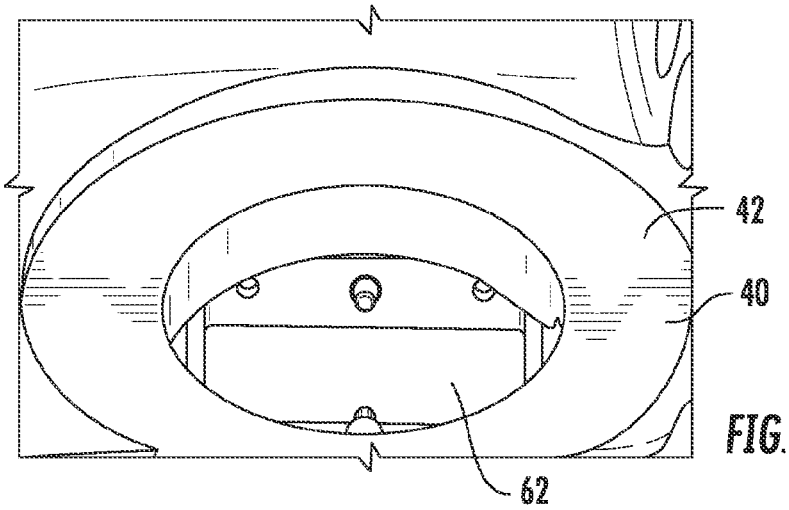
FIG. 6 is an enlarged perspective view of a portion of the gas turbine as shown in FIG. 3, according to at least one embodiment of the present disclosure.
Figure 7:
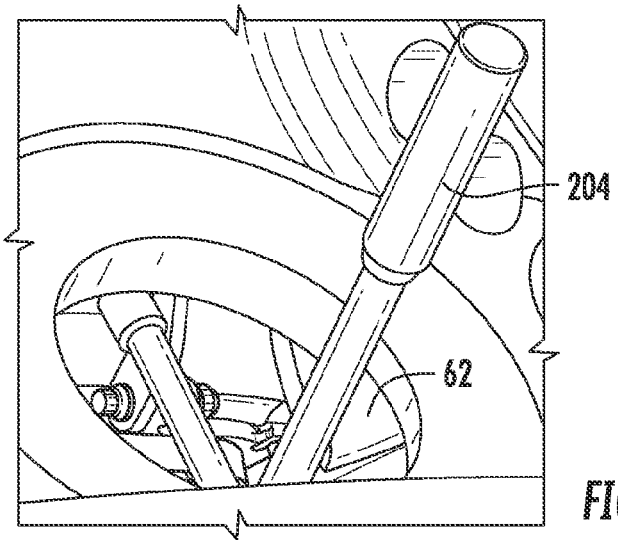
FIG. 7 is an enlarged perspective view of a portion of the gas turbine as shown in FIG. 3, according to at least one embodiment of the present disclosure.
Figure 8:
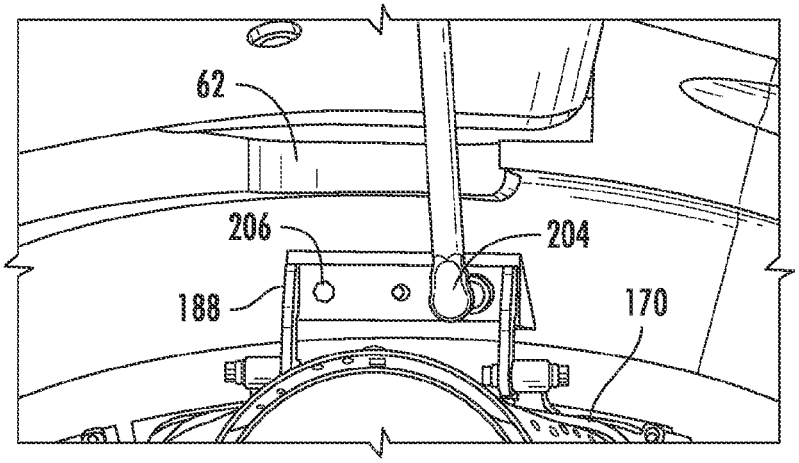
FIG. 8 is an enlarged perspective view of a portion of the gas turbine as shown in FIG. 3, according to at least one embodiment of the present disclosure.

In particular embodiments, as shown in FIG. 5, the fuel distribution manifold 132 includes an annular inner sleeve 150 and an annular outer sleeve 152 that extend between the mounting flange 136 and the support ring 140. As shown, the outer sleeve 152 is radially separated from the inner sleeve 150 to at least partially define a fuel plenum 154 therebetween. In particular embodiments, as shown in FIG. 3, the mounting flange 136 includes an inlet port 156. The inlet port 156 may be in fluid communication with the fuel supply 22 (FIG. 1) and/or with the fuel plenum 154. As shown in FIG. 4, the mounting flange 136 may at least partially define the fuel plenum 154.

The mounting flange 136 generally includes a pair of opposing mating sides or surfaces 158. The pair of opposing mating surfaces 158 generally comprises a first mating side or surface 160 that is axially separated from a second mating side or surface 162. In particular embodiments, as shown in FIG. 3, the first mating surface 160 is coupled to the outer mating surface 48 of the compressor discharge casing 40. In further embodiments, the aft end 104 of the spacer casing 102 is coupled to the second mating surface 162. A plurality of fasteners 164 extends through the aft end of the spacer casing 102 and/or the mounting flange 136 and into the fastener holes 50 disposed within the compressor discharge casing 40 to couple the fuel distribution manifold 132 to the outer mating surface 48 of the compressor discharge casing 40.

As shown in FIG. 4, the fuel injection assembly 134 generally includes an annular support sleeve 166 disposed proximate to a forward end 168 of the fuel injection assembly 134, and an aft frame 170 that at least partially defines an aft end 172 of the fuel injection assembly 134. In particular embodiments, as shown in FIG. 4, the aft frame 170 is coupled to the support sleeve 166 by at least one of an annular flow sleeve 174 or an annular impingement sleeve 176 that extends at least partially between the aft frame 170 and the support sleeve 166.

FIG. 5 provides an enlarged view of a portion of the combustion module 130 as outlined by dashed line 177. As shown in FIG. 5, a forward portion 178 of the support sleeve 166 is at least partially circumferentially surrounded by the inner portion 146 of the support ring 140. In particular embodiments, a spring seal 180 such as a hula seal extends radially between the forward end 178 of the support sleeve 166 and the inner portion 146 of the support ring 140. The spring seal 180 generally provides structural support between the fuel distribution manifold 132 and the fuel injection assembly 134 during installation and/or operation of the gas turbine 10.

As shown in FIG. 4, the aft frame 170 generally includes an inner portion 182 that is radially separated from an outer portion 184. In particular embodiments, a mounting bracket 188 is coupled to the outer portion 184 of the aft frame 170 via a boss 190 or other coupling feature. The mounting bracket 188 may pivot about the boss 190 and/or may be fixed in position. For example, the mounting bracket 188 may pivot or rotate in a forward direction and/or aft direction with respect to an axial centerline of the combustion module 130. In this manner, the position or orientation of the mounting bracket 188 may be manipulated before and/or during installation of the combustion module 130 to accommodate for tolerance stack up issues and/or to guide the combustion module 130 into position during installation into the gas turbine 10. In addition, the mounting bracket 188 may pivot as the gas turbine 10 transitions between various thermal transient conditions such as during startup, shutdown and/or turndown operation. In one embodiment, as shown in FIG. 3, an alignment feature 192 such as a guide pin extends from the mounting bracket 188.

In particular embodiments, as shown in FIGS. 3, 4 and 5, the fuel injection assembly 134 further comprises an annular liner 194 such as a combustion liner or a transition duct that extends from the aft frame 170 towards the support sleeve 166. As shown in FIGS. 3 and 4, the liner 194 may at least partially define a fuel injector passage 196 that extends generally radially through the liner 194. In particular embodiments, the liner 194 may define a plurality of the fuel injector passages 196.

A fuel injector 198 may extend at least partially through the fuel injector passage 196. In various embodiments, as shown in FIG. 4, the fuel injection assembly 134 may further include an annular or semi annular outer flow sleeve 200 that circumferentially surrounds the flow sleeve 174 and/or the fuel injector 198. As shown in FIG. 5, a portion of the outer flow sleeve 200 circumferentially surrounds the outer portion 148 of the support ring 140. In particular embodiments, a spring seal 202 such as a hula seal extends radially between the outer flow sleeve 200 and the outer portion 148 of the support ring 140. The spring seal 202 generally provides structural support between the outer flow sleeve 200 and the fuel distribution manifold 132 during installation and operation of the combustion module 130.

The various embodiments as shown in FIGS. 2 through 8 and as described herein provide for a combustor support assembly for mounting a combustion module of the gas turbine 10. For example, according to one embodiment, as shown in FIG. 3, the aft end 172 of the combustion module 130 is inserted through the combustor opening 46 in the compressor discharge casing 40. The aft frame 170 and/or the mounting bracket 188 are aligned with the inner mating surface 58 of the outer turbine shell 42 using the alignment feature 192 and or by guiding the combustion module 130 into place through the service access opening 62. In addition, jacking tools (not shown) may be used to align the combustion module 130 into position. The mounting flange 136 may be aligned to the outer mating surface 48 of the compressor discharge casing 40 via the guide pin 52.

A tool 204 such as a pneumatic wrench may be inserted through the service access opening 62 to couple the mounting bracket 188 to the inner turbine shell 42. The cap assembly 112 may be inserted through the combustor opening 46 and mounted to the combustor 100 so that the downstream end 120 of the cap assembly 112 circumferentially surrounds a portion of the liner 194. The end cover 106 and the spacer casing 102 are positioned such that the aft end 104 of the spacer casing 102 is adjacent to the second mating surface 162 of the mounting flange 136. The spacer casing 102 is coupled to the second mating surface 162 of the mounting flange 136 and the compressor discharge casing 40 by the plurality of the fasteners 164. In this manner, the combustion module 130 is constrained at both the combustor opening 46 and at the aft frame 170.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustor support assembly, comprising:

a turbine including an outer turbine casing circumferentially surrounding an inner turbine casing, the outer turbine casing defining an inner mating surface;

a compressor discharge casing coupled to the outer turbine casing and defining a combustor opening;

a combustion module comprising:

an annular mounting flange connected to the compressor discharge casing and an annular support ring coupled to the mounting flange and extending through the combustor opening into the compressor discharge casing;

an aft frame disposed at a downstream end of the combustion module, the aft frame having a mounting bracket disposed along an outer portion of the aft frame, the aft frame rigidly connected to the mating surface of the outer turbine casing via the mounting bracket;

an annular flow sleeve having a forward portion at least partially surrounded by a portion of the support ring and an aft portion coupled to the aft frame;

an outer flow sleeve connected to an outer surface of the annular flow sleeve, wherein the outer flow sleeve comprises an upstream end portion that extends circumferentially around an outer surface of the support ring, wherein the outer flow sleeve moves axially with respect to the support ring; and a first spring seal that extends radially between an inner surface of the support ring and the outer surface of the annular flow sleeve, wherein the annular flow sleeve moves axially with respect to the support ring.

2. The combustor support assembly as in claim 1, further comprising a guide pin that extends outwardly from the inner mating surface of the outer turbine casing.

3. The combustor support assembly as in claim 1, wherein the aft frame moves with the outer turbine casing independent of the inner turbine casing.

4. The combustor support assembly as in claim 1, wherein the aft frame is secured in position at a single connection point within the outer turbine casing via the mounting bracket.

5. The combustor support assembly as in claim 1, further comprising a second spring seal that extends radially between the outer surface of the support ring and an inner surface of the outer flow sleeve.

6. The combustor support assembly as in claim 1, wherein at least one of the outer turbine casing and the compressor discharge casing defines a service access opening proximate to the mounting bracket.

7. The combustor support assembly as in claim 1, wherein the mounting flange defines a fuel plenum therein.

8. The combustor support assembly as in claim 1, Wherein the support ring defines a fuel plenum therein.

9. The combustor support assembly as in claim 1, wherein the combustion module further comprises an annular liner that extends axially within the flow sleeve, wherein a downstream end of the liner is coupled to the aft frame and an upstream end portion of the liner is circumferentially surrounded by the forward portion of the flow sleeve.

* * * * *